United States Patent [19]

Mulkey

[11] 4,250,608

[45] Feb. 17, 1981

[54] LABEL INSERT AID

[76] Inventor: Donna J. Mulkey, 5741 Sunset Rd., Fort Worth, Tex. 76114

[21] Appl. No.: 17,622

[22] Filed: Mar. 5, 1979

[51] Int. Cl.[3] ..... B25B 27/14

[52] U.S. Cl. ..... 29/278; 40/359; 40/360

[58] Field of Search ..... 29/278, 270; 81/3 R; 24/255 R, 259 R, 259 FS, 49 C, 81 MC, 81 PC, DIG. 8; 40/23 A, 360

[56] References Cited

U.S. PATENT DOCUMENTS

| | | | |
|---|---|---|---|
| 60,130 | 12/1866 | Beardman . | |
| 488,510 | 12/1892 | Unbehend | 29/278 |
| 510,014 | 12/1893 | Fairchild . | |
| 1,584,238 | 5/1926 | Menger | 40/360 |
| 1,757,122 | 5/1930 | Hunter | 40/360 |
| 2,567,181 | 9/1951 | Bye | 29/270 |

*Primary Examiner*—James L. Jones, Jr.

*Attorney, Agent, or Firm*—Donald J. Singer; Arsen Tashjian

[57] ABSTRACT

A device for inserting a typed or printed label into a label holder on the upper edge of a file folder including two, thin, flat, elongated, juxtaposed clamping blades and a handle on one end. The blades possess some spring action to normally urge them together and are of unequal lengths to facilitate their insertion into the label holder. The label extends slightly beyond the outer ends of the blades to permit grasping the label and holding it in position during withdrawal of the device.

3 Claims, 3 Drawing Figures

FIG. 1
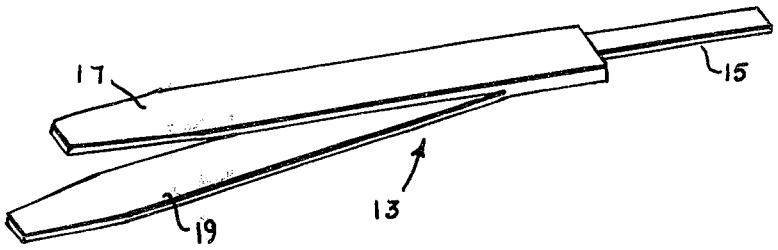
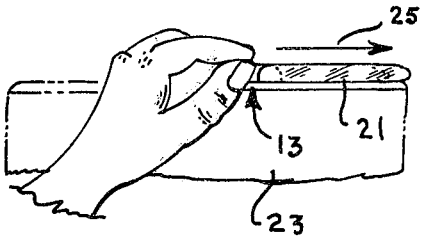
FIG. 2
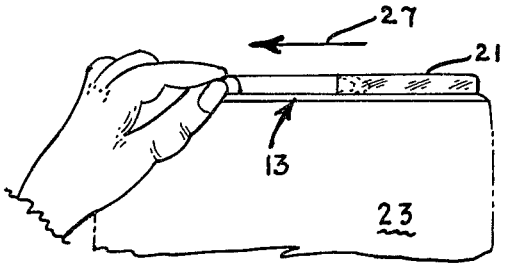
FIG. 3

LABEL INSERT AID

STATEMENT OF GOVERNMENT INTEREST

The invention described herein may be manufactured and used by or for the Government for governmental purposes without the payment of any royalty thereon.

BACKGROUND OF THE INVENTION

This invention relates to an aid for inserting labels into file folders and, more particularly, the invention is concerned with providing a device into which a label insert can be positioned after which the device is inserted into the tab on a file folder and withdrawn, leaving the label remaining in position in the file folder tab.

Heretofore, it has been common practice to insert labels into the tabs on file folders by hand without the use of any insertion aid. Since the labels, sometimes called tab inserts, are made of heavy weight paper, it is extremely difficult to accomplish this without bending and/or damaging the inserts. This causes loss of time as well as loss of tab inserts because of damage and resultant waste. The inserts or labels may be trimmed making them easier to insert. However, when this is done, the labels have a tendency to fall out of the file folder tab causing further problems of spending time to locate and reinsert the proper label in the proper file folder. Thus, it can be seen that there is a defininte need for a quick and easy system for inserting tabs into file folders and that a simple tool for this purpose would be most useful.

SUMMARY OF THE INVENTION

The invention is concerned with providing a simple tool which would be easy to use for the purpose of inserting labels into the tabs on file folders such as, for example, the official personnel folders of government employees. The tool includes two thin, firm blades extending from a handle. The blades are disposed one over the other with the lower blade being slightly longer than the upper blade. The blades can be slightly separated at their outer ends to receive a label therebetween and are held together by spring action after the label is in position. The tool with the label therein is then fully inserted into the tab on the file folder after which the label is grasped and held in place while the tool is withdrawn.

Accordingly, it is an object of the invention to provide a label insert aid for quickly and easily inserting heavy paper labels into file folder tabs without damaging the labels or taking extra time in the procedure.

Another object of the invention is to provide a tool for inserting labels into the tabs on file folders including a handle with two outwardly extending one-over-the-other blades between which the label is held prior to insertion.

Still another object of the invention is to provide a label insert aid which includes two thin blades which hold the label insert and prevent damage while it is being inserted into the file folder tab.

A further object of the invention is to provide a device for inserting a typed or printed label into a label holder on the upper edge of a file folder wherein two blades extending outwardly from a handle are held slightly apart to receive the labels therebetween. The blades spring closed and the device inserted into the file folder tab and then withdrawn leaving the label in position on the file folder.

Another further object of the invention is to provide a device for inserting labels into file folder tabs wherein the blades holding the labels are of uneven lengths with the upper blade being shorter then the lower blade to facilitate insertion and removal of the device without damage to the label held therein.

These and other objects, features and advantages will become more apparent after considering the following detailed description taken in conjunction with the annexed drawing and appended claims.

BRIEF DESCRIPTION OF THE DRAWING

FIG. 1 is a view in perspective of a label insert aid according to the invention showing the handle and the blades open to receive the label for insertion;

FIG. 2 is a view showing a label being inserted into a file folder tab using the label insert aid; and FIG. 3 is a view showing the label insert aid being withdrawn after inserting the label which remains in position on the file folder.

DESCRIPTION OF A PREFERRED EMBODIMENT

Referring now to the Figures in which like reference numerals refer to like elements in the several views, there is shown a label insert aid 13 according to the invention. A handle 15 is used to grasp the aid 13 during use thereof. An upper blade 17 and a lower blade 19 extend outwardly from the handle 15. As shown in FIG. 1, the lower blade 19 is slightly longer than the upper blade 17. The spring action on the handle 15 holds the blades 17 and 19 together after the label is inserted therebetween.

The operation of the aid 13 is shown in FIGS. 2 and 3. In FIG. 2 the aid 13 with the label therein is being inserted into the tab 21 on the file folder 23 by moving to the right in the direction of the arrow 25. As shown, the label is fully inserted in position. In FIG. 3, the aid 13 is being withdrawn from the tab 21 on the file folder 23 by moving to the left in the direction of the arrow 27. The label remains in the tab 21 while the aid 13 is withdrawn. The aid 13 is designed so that the corners of the label are exposed at the tapered portion of the ends of the blades 17 and 19 and extend beyond the outer end of the tab 21 after insertion so that the label can be grasped to prevent its pulling out when the aid 13 is removed.

In a typical tab insert aid the blades 17 and 19 and handle 15 could be made of hard plastic and/or metal. The overall length including the handle would be about six and one-half inches long with the shorter blade 17 being about five inches long and the longer blade 19 being five and one-half inches long. The width of the blades 17 and 19 would be approximately the same width as the labels which is slightly less than the height of the file folder tab 21 and tapered at their outer ends to facilitate their insertion into the file folder tab 21.

Although the invention has been illustrated in the accompanying drawing and described in the foregoing specification in terms of a preferred embodiment thereof, the invention is not limited to this embodiment. It will be apparent to those skilled in the art that the hereinbefore described label insert aid can be used in other operations where it is necessary and/or desirable to insert a substantially flexible or pliable flat member into a close fitting slot. Also, it should be noted that certain changes, modifications and substitutions can be made in the construction details of the invention without departing from the true spirit and scope of the appended claims.

Having thus set forth the nature of my invention, what I claim and desire to secure by Letters Patent of the United States is:

1. A label insert aid for facilitating the insertion of a label into a label holder on a file folder, said aid comprising a handle, a pair of thin, flat, elongated juxtaposed blades extending outwardly from said handle, said blades being normally held in a closed together relationship by spring action, and a label held between said blades which remains in position in the aid during insertion into the label holder and allows the aid to be withdrawn while the label is held in position in the label holder thereby allowing the label to be quickly and easily inserted into the label holder without bending and damaging the label.

2. The label insert aid defined in claim 1 wherein said thin, flat, elongated, juxtaposed pair of blades are of unequal lengths, said blades being in one-over-the-other relationship, the lower of said blades being longer than the upper of said blades thereby facilitating their insertion into the file folder label holder.

3. The label insert aid defined in claim 2 wherein said thin, flat, elongated, juxtaposed pair of blades are tapered at their outer tip ends thereby further facilitating their insertion into the file folder label holder.

* * * * *